United States Patent [19]

Dalton

[11] 4,138,117

[45] Feb. 6, 1979

[54] GOLF CLUB HEAD

[76] Inventor: John A. Dalton, 166 Booran Rd., Glenhuntly, Victoria, Australia, 3163

[21] Appl. No.: 723,445

[22] Filed: Sep. 15, 1976

[51] Int. Cl.[2] ..... A63B 53/04

[52] U.S. Cl. ..... 273/164; 273/78; 273/80 C; 273/167 F; 273/167 G

[58] Field of Search ..... 273/77 R, 78, 80 C, 273/167–175, 80.2

[56] References Cited

U.S. PATENT DOCUMENTS

| | | | |
|---|---|---|---|
| D. 185,522 | 6/1969 | Whitney | 273/80 C X |
| D. 185,684 | 7/1959 | Todd | 273/80 C X |
| 1,703,199 | 2/1929 | McClure | 273/164 X |
| 2,820,638 | 1/1958 | Morrison | 273/164 |
| 2,954,231 | 9/1960 | MacIntyre | 273/164 |
| 3,219,348 | 11/1965 | Dishner | 273/80 C X |
| 3,399,898 | 9/1968 | Burkland | 273/164 |
| 3,663,019 | 5/1972 | Palotsee | 273/78 X |
| 3,758,115 | 9/1973 | Hoglund | 273/164 |
| 3,819,180 | 6/1974 | Murphy | 273/167 E X |
| 3,888,484 | 6/1975 | Zitko | 273/167 G X |
| 3,954,265 | 5/1976 | Taylor | 273/167 G X |
| 3,966,210 | 6/1976 | Rozmus | 273/167 G X |
| 4,063,733 | 12/1977 | Benedict | 273/167 G X |

FOREIGN PATENT DOCUMENTS

| | | | |
|---|---|---|---|
| 727051 | 3/1955 | United Kingdom | 273/80 C |
| 1232651 | 5/1971 | United Kingdom | 273/80 C |

OTHER PUBLICATIONS

"Golf World," Jan. 4, 1972, p. 36.
"Golf Digest," Jul. 1971, p. 87.

*Primary Examiner*—Richard J. Apley
*Attorney, Agent, or Firm*—Browdy and Neimark

[57] ABSTRACT

The head of a golf putter has a body elongated in the longitudinal direction and having a striking portion with a strike face extending in a direction transverse to the longitudinal direction of the body. An extension of the longitudinal axis of the shaft of the putter passes through the center of mass of the head but the shaft itself is connected to the head by means of a connector member having a portion which extends upwardly from the head in a direction normal to both the longitudinal and transverse directions, and a second portion connecting the first portion with the shaft.

8 Claims, 4 Drawing Figures

FIG. 1.
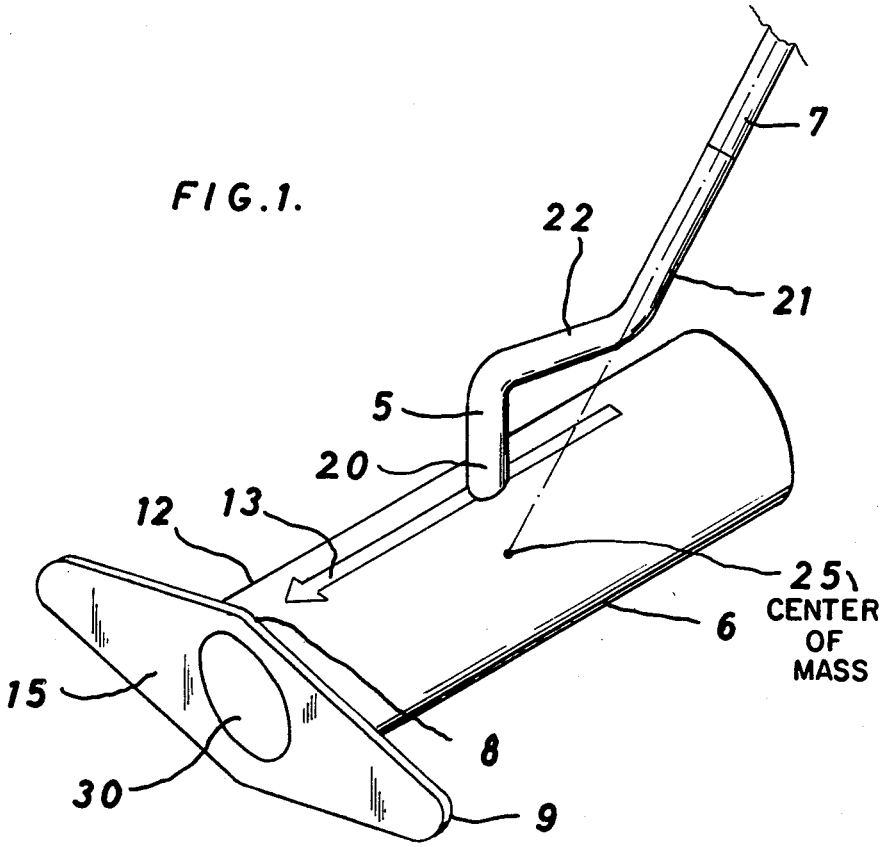
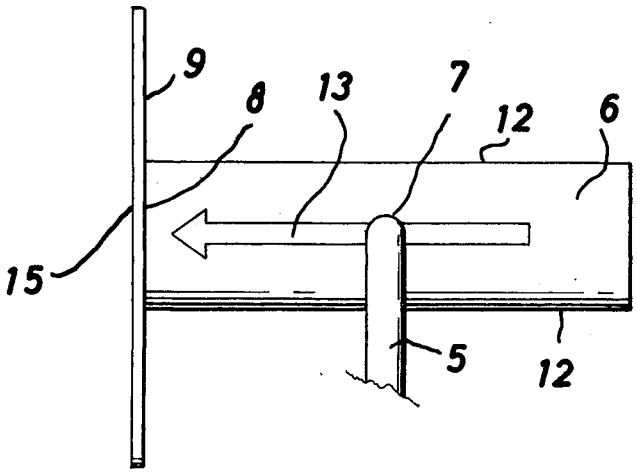
FIG. 2.

FIG. 3.
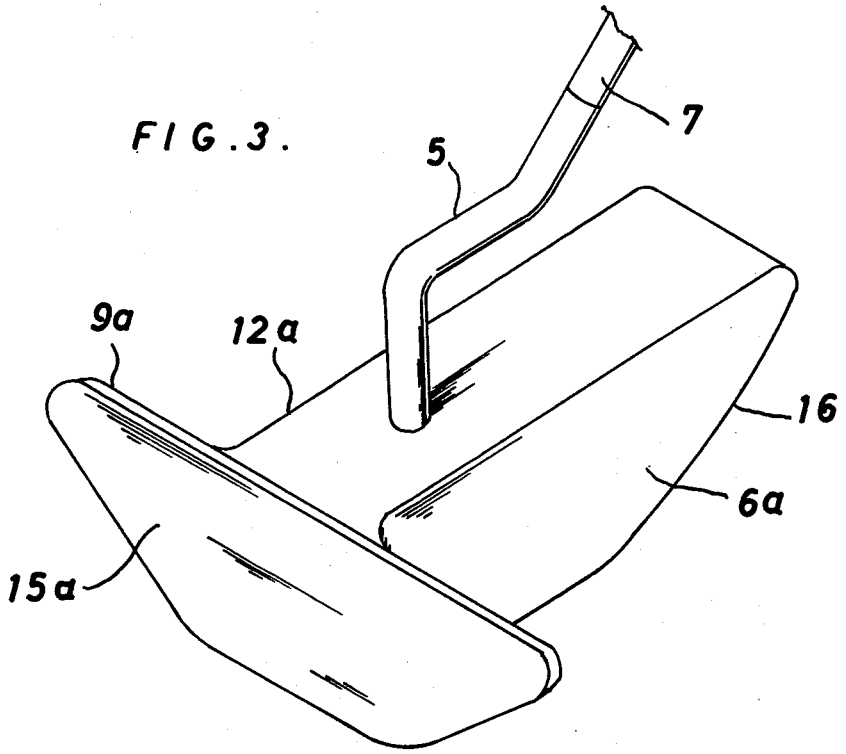
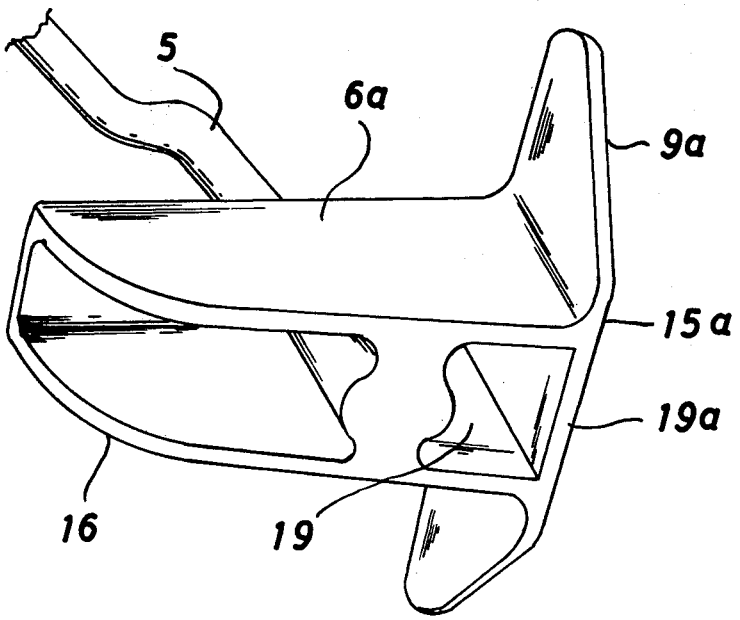
FIG. 4.

GOLF CLUB HEAD

This invention relates to a head for a golf club used for putting the golf ball once it has reached the putting green; generally referred to as a "putter".

The principal skill in accurate putting of a golf ball is to correctly align the face of the putter which strikes the ball, with respect to the line the ball must travel to enter the hole. The presently known putter head is of the common blade shape having an elongated striking face and a thickness of only about half an inch. Accordingly the putter head has no substantial dimension in the direction of the line of travel of the ball, and thus in order to correctly align the putter with the required line of travel of the ball, the player must attempt to ensure that the striking face is at right angles to the line of travel. It will be appreciated that considerable skill is required to accurately determine that the striking face of the putter is at right angles to the required line of travel, particularly as the putter head has no substantial dimension in that direction.

Also, in many putters the area on the striking face of the putter intended to make contact with the ball is offset with respect to the center of mass of the putter head, and/or with respect to the line of action of the force applied to the putter head through the shaft. This offset results in a turning moment acting on the putter head upon contact with the ball. If this turning moment is not fully counter-acted by the player's grip on the shaft the striking face will not remain at right angles to the required line of travel of the ball and hence the ball will be deflected from the required line of travel.

It is the object of the invention to provide a putter golf club which will assist the player in accurately positioning the striking face of the club with the required line of travel of the ball.

It is also an object of the present invention to provide a putter golf club which will reduce or eliminate any tendency for the club to turn in the player's hand upon contact with the ball.

With these objects in view there is provided a golf putter comprising a head, a shaft and a connector member attaching the shaft to the head;

said head comprising a body elongated in the longitudinal direction, a striking portion at one end of the body and having a strike face extending in a direction transverse to the longitudinal direction of the body, said strike face having a dimension in the transverse direction greater than the total length of the head in said longitudinal direction;

said shaft being straight with an extension of the axis thereof passing through the center of mass of the head; and said connector member having a first portion connected to the body and extending upwardly therefrom in a direction normal to both said longitudinal and transverse directions, a second portion offset from the first portion and connected co-axially to the shaft, and an offsetting portion connecting said first and second portions.

By providing a head which is elongated in a direction normal to the striking face, rather than the conventional construction which is elongated in the direction of the striking face, a substantial portion of the head is provided for alignment with the desired direction of travel of the ball, and when so aligned the striking face is normal to said line of travel.

Preferably the head is provided with a sight line which is normal to the striking face, and at a location to be conveniently viewed by the player when the club is in use. The sight line further assists the player to achieve the required alignment of the striking face with the line of travel of the ball.

More conveniently the head may be so shaped as to provide an edge of the head normal to the striking face, this edge provides a sight line for the player. In one practical arrangement the head is of a prismatic shape with one end face forming the striking face. The sight line may also be provided on a face of the head such as by engraving, painting and the like.

The putter is used so that the ball will contact the strike face in an area in alignment with the elongated body, preferably in alignment with the longitudinal axis of the body. The center of mass of the head is located on the longitudinal axis of the body, and as the axis of the shaft also extends through the center of mass, the force applied to the head through the shaft will not produce any turning moment when the ball is struck.

The offset connector member enables the shaft to be connected to the head with the portion adjoining the head disposed vertical when the club is in use. Accordingly during use of the putter the head travels in the manner of a pendulum without the need for the complete shaft to be vertical. It has been found that it is desirable for the putter head to move in the manner of a pendulum when in use, while at the same time the shaft should not be vertical. This combination of features as provided by the present putter significantly improves the accuracy, and provides greater control by the player, during putting.

Preferably, the putter is constructed so that the axis of the shaft and the center line of the first, second and offsetting portions of the connector member are located in a common plane transverse and normal to the longitudinal direction of the body.

Although the striking portion extends laterally on either side of the body the extensions are not intended to be used to strike the ball as the most accurate results are achieved by striking the ball with the end face of the head so that the mass of the head is in line with the point of contact with the ball and the desired line of travel of the ball. The extensions may be formed of a light material, such as aluminium or impact resistant plastic sheet material. Preferably, the extension or extensions are made of a transparent material so they will provide a minimum of obstruction and distraction to the player when using the putter.

The invention will be more readily understood from the following description of the embodiments of the invention as illustrated in the accompanying drawings.

In the drawings:

FIG. 1 is a perspective view of a golf putter having a circular section body

FIG. 2 is a plane view of the putter shown in FIG. 1

FIG. 3 is a perspective view of a putter having a square section body

FIG. 4 is a perspective view from the underside of the putter shown in FIG. 3

Referring now to FIGS. 1 and 2 of the drawings, the putter comprises a cylindrical body 6 to which a shaft 7 is connected by a connector member 5. In one form of the putter which has been produced commercially the body is approximately 1¼" in diameter and 4" long.

Attached to the end 8 of the body is a laterally extending striker member 9 which extends on either side of the body and provides the striker face 15. The overall length of the striker member 9 is greater than the length of the putter head measured in a direction normal to the striker face 15, that is the longitudinal direction of the body 6.

The putter head, comprising the body 6 and the striker member 9, may be made of any suitable material, and may be made of different materials. In the preferred construction the body 6 is made of metal and the striker member 9 of a thermoplastic material having the desired physical properties of impact resistance so that it will not be damaged during use. It is to be noted that the putter is to be used to strike the ball with that portion of the striker member 9 aligned with the end 8 of the body 6, and the extending portions of the striker member are not required to have sufficient strength to permit them to be used to strike the golf ball.

It will be clearly seen that when a player is using the putter the axial surface of the cylindrical body is normal to the striker face 15 which is to strike the ball. Accordingly, the player when using the putter has the edge 12 of the axial surface normal to the striker face to employ as a guide to obtain the correct positioning of the striking face 15 to ensure that the ball will travel the correct line to enter the hole. A sight line 13 may be provided on the axial surface of the body, in alignment with the center of the striker face 15, which the player may use to obtain the required alignment of the putter ball and hole.

The connector member 5 may be made integral with the putter head 6 or the shaft 7 and connected to the other, or may be a separate component connected to both the head and shaft. The connector member 5 has a first or head portion 20 connected to the head 6 to extend normal to the longitudinal and transverse axes of the head. The second or shaft portion 21 is connected to the end of the shaft 7, and the first and second portion are angularly related and joined by the offsetting portion 22 so that when connecting the head and shaft the extension of the axis of the shaft passes through the center of mass of the head indicated at 25.

The three portions 20, 21 and 22 of the connector member 5, and the shaft 7, are co-planar as shown in the drawing, but this is not essential, provided the extension of the axis of the shaft 7 passes through the center of mass of the head.

The putter shown in FIGS. 3 and 4 of the drawings has the same basic construction as that described with reference to FIGS. 1 and 2 except that the body **6*a* is of rectangular (in this example square) cross section, and a portion of this body at the end, opposite to that to which the striker member 9*a* is attached, is tapered upwardly from the lower edge 16 to form an inclined face 17**. The provision of the inclined face, will vary the balance of the putter so as to locate the center of gravity closer to the striking face.

It will be seen that this body **6*a* also provides an edge 12*a* normal to the striking face 15*a* which may be used by the player to correctly align the striking face 15*a*** with the ball to achieve the desired path of travel.

In the embodiment shown in FIGS. 3 and 4, the head is provided with a cavity 19 in the underside immediately behind the striker face **15*a*. The cavity 19 will naturally influence the weight and balance of the putter, but it has been found to also influence the rebound characteristic of the putter. It is believed that the cavity results in a degree of flexibility in the striker face 15*a* so that when a ball is struck the ball rebounds off the striker face slower than it would if the putter head was solid. The rebound characteristic is dependant on the size of the cavity 19 and in particular the thickness of the wall 19*a*** between the cavity and the striker face.

It is to be understood that a cavity similar to that shown in the head illustrated in FIGS. 3 and 4 may also be incorporated in the putter shown in FIGS. 1 and 2. The rebound characteristics of the putter may also be influenced by hardness of the material of the striker face. A soft material will give a slow rebound characteristic, and as the hardness increases the rebound also increases in speed. As shown in FIG. 1 an insert 30 of material softer than the material of the head may be provided in a center recess in the striker face. The hardness of the material of the insert is selected in accordance with the required rebound characteristics.

I claim:

1. A golf putter comprising a head, a shaft and a connector member attaching the shaft to the head;

said head comprising a body elongated in the longitudinal direction, a striking portion at one end of the body and having a strike face extending in a direction transverse to the longitudinal direction of the body;

said shaft being straight with an extension of the axis thereof passing through the center of mass of the head; and said connector member having a first portion connected to the body such that an extension of the axis of said first portion passes through the longitudinal axis of the body, and extending upwardly from the body in a direction normal to both said longitudinal and transverse directions, a second portion offset from the first portion and connected coaxially to the shaft, and an offsetting portion connecting said first and second portions.

2. A golf putter as claimed in claim 1 wherein the body of said head is formed with at least one straight edge extending normal to the strike face and located to be within the view of a user of the putter.

3. A golf putter as claimed in claim 1 wherein the axis of the shaft and the center line of the first, second and offsetting portions of the connector member are located in a common plane transverse and normal to the longitudinal direction of the body.

4. A golf putter as claimed in claim 1 wherein the body is formed with a cavity in the underside thereof adjacent the junction of the body and striking portion.

5. A golf putter as claimed in claim 1 wherein a recess is formed in the strike face of the striking portion opposite the body, and an insert of material softer than the material of the striking portion and body is located therein.

6. A golf putter as claimed in claim 2 wherein the axis of the shaft and the center line of the first, second and offsetting portions of the connector member are located in a common plane transverse and normal to the longitudinal direction of the body.

7. A golf putter in accordance with claim 1, wherein said strike face has a dimension in the transverse direction greater than the total length of the head in said longitudinal direction.

8. In a golf putter comprising a head having a strike face, a shaft and a connector member attaching the shaft to the head, the improvement wherein:

said shaft is straight with an extension of the axis thereof passing through the center of mass of the head; and said connector member has a first portion connected to the head such that an extension of the axis of said first portion passes through the center of mass of the head, said first portion extending upwardly from the head vertically when the strike face of the head is vertical, a second portion offset from the first portion and connected coaxially to the shaft, and an offsetting portion connecting said first and second portions.

* * * * *